US005297120A

United States Patent [19]

Yuzuki et al.

[11] Patent Number: 5,297,120

[45] Date of Patent: Mar. 22, 1994

[54] RADIO WAVE-STANDARDIZED ELECTRONIC TIMEPIECE

[75] Inventors: Toshiyuki Yuzuki; Yuichi Inoue; Kazumi Sakumoto, all of Tokyo, Japan

[73] Assignee: Seiko Instruments Inc., Japan

[21] Appl. No.: 24,493

[22] Filed: Mar. 1, 1993

[30] Foreign Application Priority Data

Mar. 4, 1992 [JP] Japan ..... 4-047262

[51] Int. Cl.[5] ..... G04C 11/02

[52] U.S. Cl. ..... 368/47

[58] Field of Search ..... 368/10, 46, 47, 49, 368/51; 375/107-108, 111, 118; 455/170.1, 180.1, 181.1, 182.1

[56] References Cited

U.S. PATENT DOCUMENTS

| | | | |
|---|---|---|---|
| 4,117,661 | 10/1978 | Bryant, Jr. | 368/47 |
| 4,440,501 | 4/1984 | Schultz | 368/47 |
| 4,543,657 | 9/1985 | Wilkinson | 375/1 |
| 4,556,988 | 12/1985 | Yoshisato | 455/182 |
| 4,582,434 | 4/1986 | Plangger et al. | 368/47 |
| 4,768,178 | 8/1988 | Conklin et al. | 368/47 |
| 5,036,500 | 7/1991 | Ganter | 368/47 |

*Primary Examiner*—Vit W. Miska

*Attorney, Agent, or Firm*—Bruce L. Adams; Van C. Wilks

[57] ABSTRACT

A radio wave-standardized electronic timepiece which stores the time at which the timepiece succeeds in reception in conformity with the pattern of living of the user, and on the following days, the timepiece begins to receive from the stored times.

A reception success comparison circuit compares the output signal from a reception success time storage circuit with the output signal from a time information calculation circuit. A reception time comparison circuit compares the output signal from a reception time addition circuit with the output signal from the time information calculation circuit. A reception operation discrimination circuit controls a receiver means according to its input signal. A transfer circuit modifies a time counter and the contents of the reception success time storage circuit according to the output signal from a received data acceptance decision circuit. A display means displays the contents according to the output signal from the time information calculation means.

3 Claims, 11 Drawing Sheets

RADIO WAVE-STANDARDIZED ELECTRONIC TIMEPIECE

BACKGROUND OF THE INVENTION

The present invention relates to a radio wave-standardized electric timepiece which receives an externally produced standard time signal and corrects the time.

It is known that the prior art radio wave-standardized electronic timepiece is automatic reception. The automatic reception means that even if the user does not operate the timepiece, it assumes a reception condition when an established time comes, and that the timepiece does not permit the user to establish a reception time suited for the living pattern of the user.

It is also known that the automatic reception assumes a reception condition from the start of a reception time zone established every day.

FIG. 2 is a block diagram of the system of the prior art radio wave-standardized electric timepiece. A divider 2 devides the frequency of the output signal from an oscillator 1. A time counter 3 consisting of an arithmetic processing circuit or the like receives the output signal from the divider 2 and produces an output signal to a display means 15. An antenna 9 receives an externally produced standard time signal. A receiver circuit 10 receives, amplifies and detects the output signal from the antenna 9.

The output signal from the receiver circuit 10 is converted into 1/0/* (* indicates a signal that cannot be converted into 1 or 0) by a received data detection circuit 11. Its data is stored in a received data storage circuit 12. A received data acceptance decision circuit 13 makes a decision to see if the received data stored in the received data storage circuit 12 contains given information.

A transfer circuit 14 produces modifying pulses to a time information calculation circuit 16 in response to the received data stored in the received data storage circuit 12 according to the output signal from the received data acceptance decision circuit 13. An established reception time is stored in N memories, starting with memory 1 and ending with memory N, included in a storage time comparison circuit 19. This storage time comparison circuit 19 receives information held in a minute counter and in an hour counter included in the time counter 3. The storage time comparison circuit 19 compares the received information with the information stored in the memories 1-N, where N is a positive integer equal to or greater than 2.

An OR circuit 20 receives the output signals from the memories 1-N of the storage time comparison circuit 19 and produces an output signal that is the logical OR of these input signals. An R-S latch 21 is set when information about the day held in the time counter 3 has changed and is reset by an output signal which is produced when the received data acceptance decision circuit 13 determines that the received data contains given information. A two-input AND circuit 22 receives the output signal from the OR circuit 20 and the output signal from the R-S latch 21 and controls the receiver circuit 10 according to the logical AND of these two input signals.

The prior art structure described above is disclosure in, for example, Patent Laid-Open Nos. JP-A-107776/1979 and JP-A-191981/1986.

However, the prior art radio wave-standardized electronic timepiece can automatically receive only in a certain time zone in a day, generally in the nighttime in which the amount of noise is small. Where the certain time zone is from 0 o'clock to 3, if the user lives in a building of reinforced concrete or the like into which radio waves cannot reach or do not easily reach, then the automatic reception is impossible. Therefore, it is difficult to correct the time by the automatic reception method. Also, in a location where the timepiece is successful in reception only at three o'clock within the above described time zone every day, the timepiece begins to assume reception condition at 0 o'clock every day. Hence, an amount of electric current is consumed wastefully.

SUMMARY OF THE INVENTION

It is an object of the present invention to provide a radio wave-standardized electric timepiece which stores reception success time adapted for the living pattern of the user and which, on the following day, is made to receive from the stored times.

In order to solve the above problems according to the present invention, the reception success time storage circuit stores the reception time in response to the output signal from the transfer circuit according to the output signal from the received data acceptance decision circuit. The reception time addition circuit adds a given time in response to the output signal from the received data acceptance decision circuit. The reception success comparison circuit receives the output signal from the reception success time storage circuit and the output signal from the time information calculation circuit and compares them. The reception time comparison circuit receives the output signal from the reception time addition circuit and the output signal from the time information calculation circuit and compares them. The reception operation decision circuit receives the output signal from the reception success comparison circuit and the output signal from the reception time comparison circuit and controls the operation of the receiver means.

In this way, the inventive radio wave-standardized electronic timepiece receives an extraneous signal with certainty and can display accurate time.

DETAILED DESCRIPTION OF THE PREFERRED EMBODIMENTS

Figure 1:
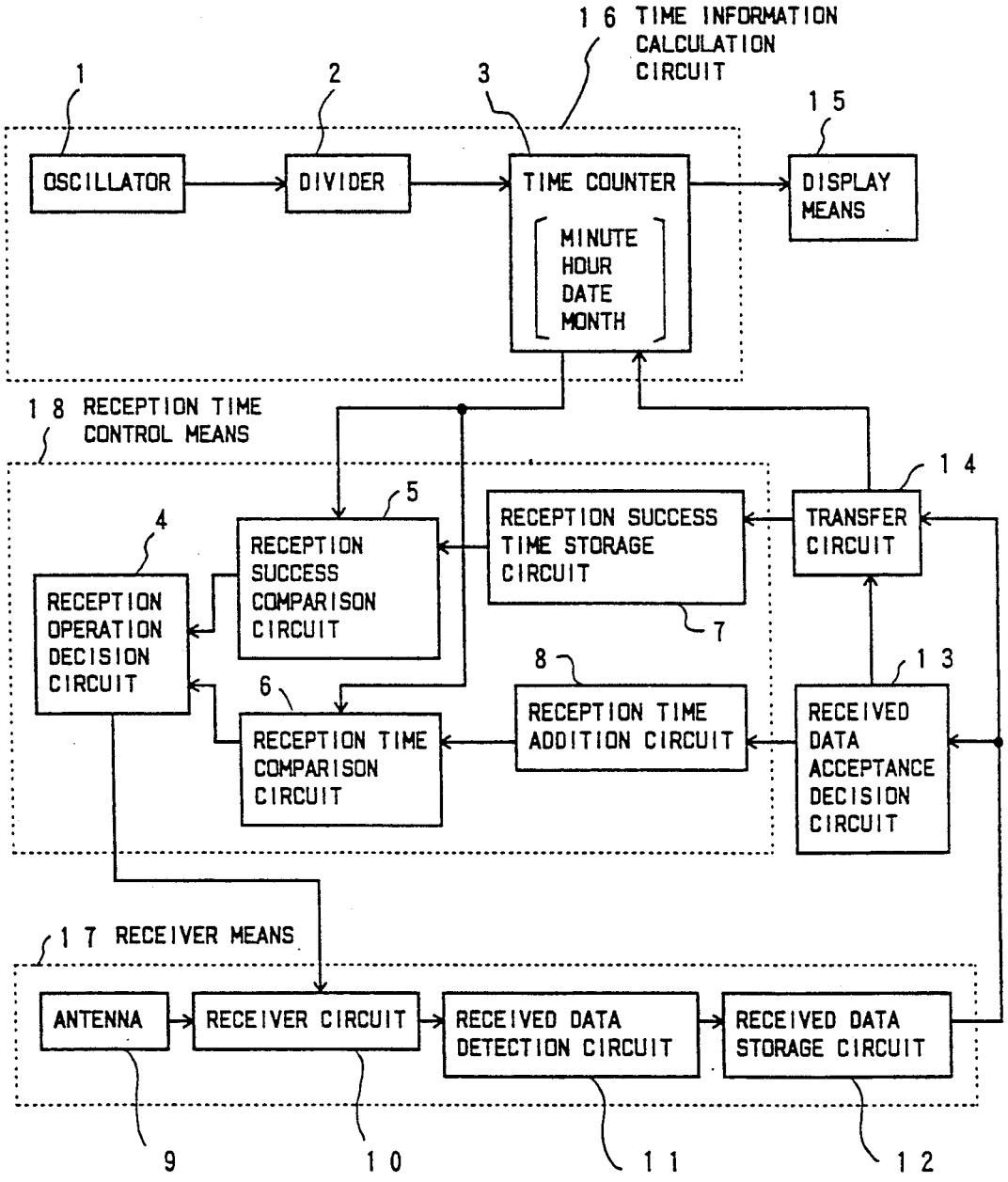
FIG. 1 is a block diagram of the system of a radio wave-standardized electronic timepiece according to the invention.
Figure 2:
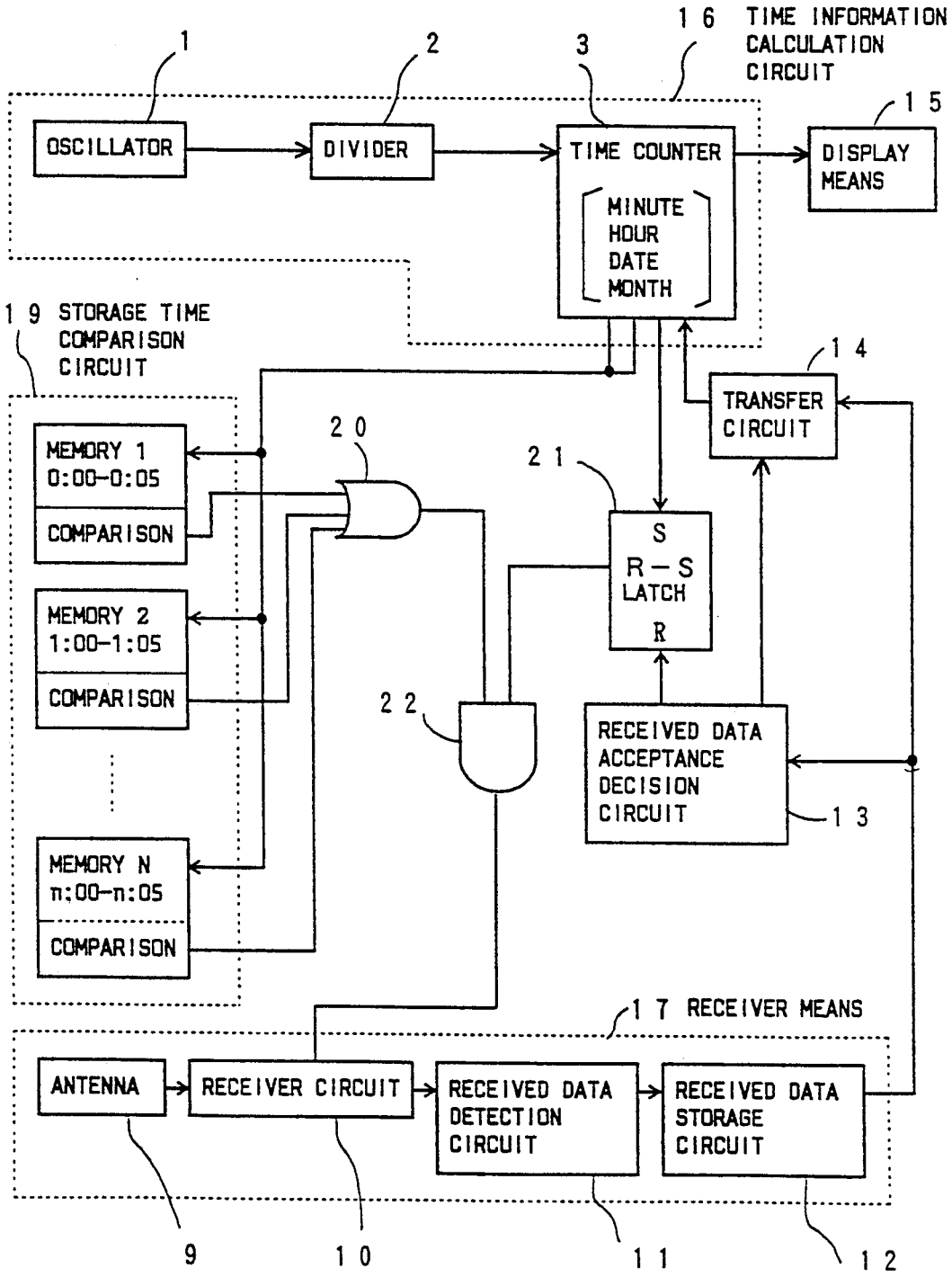
FIG. 2 PRIOR ART
FIG. 2 is a block diagram of the system of the conventional radio wave-standardized electronic timepiece.

Embodiment of the invention is hereinafter described by referring to the drawings.

FIG. 1 is a block diagram of the system of a radio wave-standardized electronic timepiece according to the invention.

A divider 2 divides the frequency of the output signal from an oscillator 1. A time counter 3 consisting of an arithmetic processing circuit or the like receives the output signal from the divider 2 and delivers an output signal from a display means 15 which displays information about time or other information. Examples of the display means include a liquid-crystal panel and display hands activated by motors and gear trains. A reception success comparison circuit 5 compares the output signal from the time counter 3 with the output signal from a reception success time storage circuit 7. The reception time comparison circuit 6 compares the output signal from the time counter 3 with the output signal from a reception time addition circuit 8.

A reception operation decision circuit 4 receives the output signal from the reception success comparison circuit 5 and the output signal from the reception time comparison circuit 6 and determines whether a receiver circuit 10 is operated or not. An antenna 9 receives a standard time signal produced externally. The receiver circuit 10 receives, amplifies, and detects the output signal from the antenna 9 according to the output signal from the reception operation decision circuit 4.

A received data detection circuit 11 converts the output signal from the receiver circuit 10 into 1/0/* (* indicates a signal that cannot be converted into 1 or 0) and stores the data in a received data storage circuit 12. A received data acceptance decision circuit 13 receives the output signal from the received data storage circuit 12 and determines whether the received data contains given information. If the received data contains the given information, the circuit 13 operates the transfer circuit 14 and produces an output signal to the reception time addition circuit 8.

The transfer circuit 14 receives the received data delivered from the received data storage circuit 12 and modifies the contents of the time counter 3 and the contents of the reception success time storage circuit 7 according to the output signal from the received data acceptance decision circuit 13.

The time information calculation circuit 16 consists of the oscillator 1, the divider 2, and the time counter 3. The antenna 9, the receiver circuit 10, the received data detection circuit 11, and the received data storage circuit 12 together form a receiver means 17. The reception operation decision circuit 4, the reception success comparison circuit 5, the reception time comparison circuit 6, the reception success time storage circuit 7, and the reception time addition circuit 8 together form a reception time control means 18.

The procedure of the operation of the invention is described in connection with Embodiments.

EMBODIMENT 1

FIGS. 3, 4, 5, 6 and 7 pertain to a radio wave-standardized electronic timepiece according to a first embodiment of the invention, the timepiece starting its next day-reception from the instant at which reception is successfully made.

Figure 3:
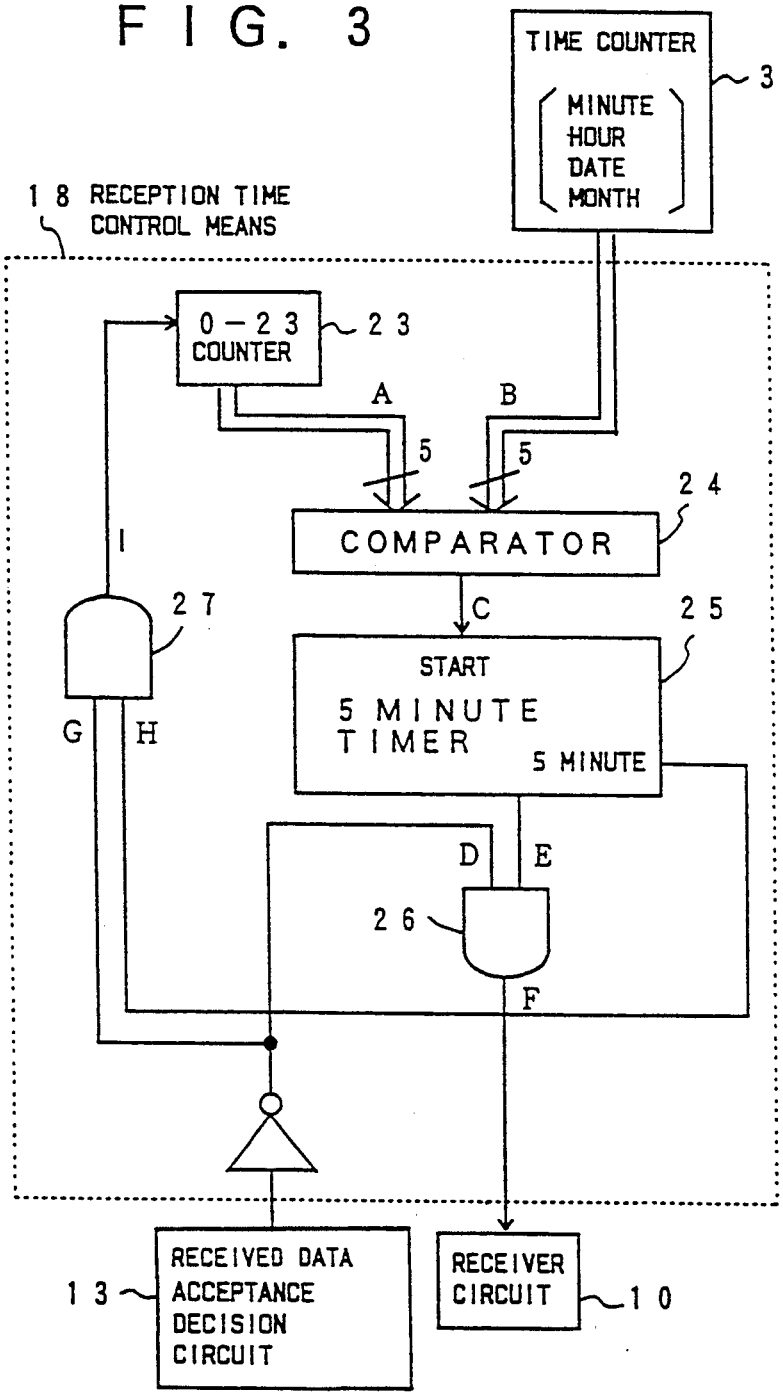
FIG. 3 is a detailed block diagram of the reception time control means of a radio wave-standardized electronic timepiece according to a first embodiment of the invention.

FIG. 3 is a specific block diagram of the reception time control means 18. A 0–23 counter 23 includes the reception success time storage circuit 7 and the reception time addition circuit 8. A comparator 24 compares an output signal A from the 0–23 counter 23 indicating information with an output signal B from the time counter 3 indicating information. If they agree, a 5-minute timer 25 is started according to an output signal C.

An output signal E from the 5-minute timer 25 is applied to one input of an AND circuit 26. The output signal from the received data acceptance decision circuit 13 is inverted by an inverter. The output signal D from the inverter is applied to the other input of the two-input AND circuit 26. This two-input AND circuit 26 controls the receiver circuit 10. The 5-minute timer 25 produces a 5-minute end pulse H when a period of 5 minutes ends, and applies this pulse to one input terminal of a two-input AND circuit 27.

The output signal from the received data acceptance decision circuit 13 is applied to an inverter. The output signal G from this inverter is applied to the other input terminal of the AND circuit 27. The output signal I from the two-input AND circuit 27 controls the 0–23 counter 23.

If the result of the decision is that the received data contains given information, the received data acceptance decision circuit 13 produces signal 1 (high level). If the received data does not contain the given information, the received data acceptance decision circuit 13 produces signal 0 (low level). When the 5-minute end pulse from the 5-minute timer 25 drops, the received data acceptance decision circuit 13 produces signal 0 (low level).

Figure 4:
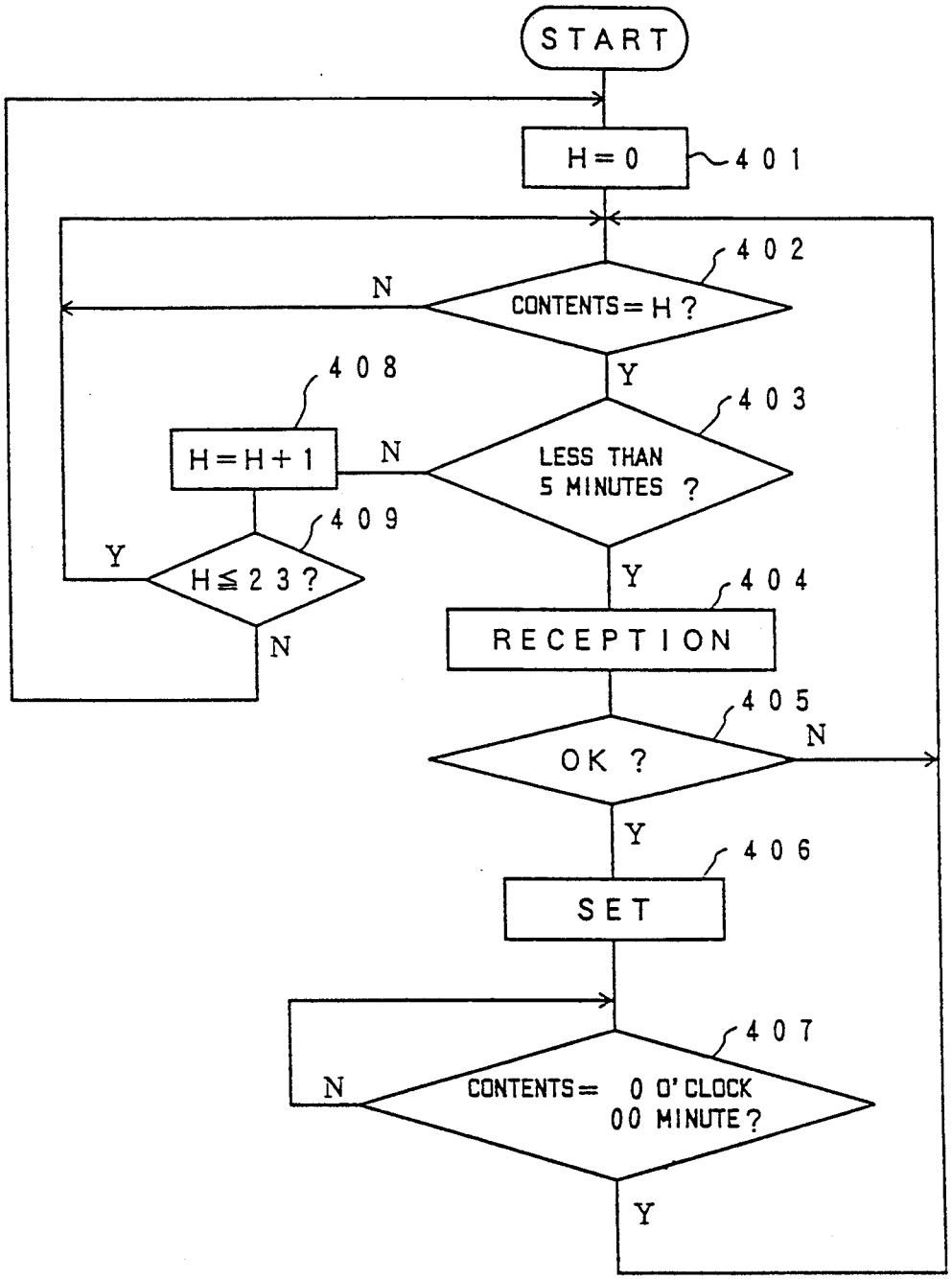
FIG. 4 is a diagrammatic flowchart illustrating the operation of the reception time control means of a radio wave-standardized electronic timepiece according to a first embodiment of the invention.

FIG. 4 is a flowchart diagrammatically illustrating the operation of the reception time control means. The initial value H of the 0–23 counter 23 is set to 0 (step 401). The contents of the time counter 3 are compared with the contents H of the 0–23 counter 23 (step 402).

A decision is made to see if a period of 5 minutes has not yet elapsed since the 5-minute timer 25 has been operated (step 403). If the elapsed time exceeds 5 minutes, the result of the decision is that the received data does not contain given information within the period of 5 minutes. The reception ends. Value 1 is added to the value H of the 0–23 counter 23 (step 408). Then, the value of the counter is controlled (step 409). If the period is less than 5 minutes, reception is done (step 404).

A decision is made to see if the received data contains the given information (step 405). If the received data contains the given information, the time counter 3 is modified according to the received data (step 406). The control is continued unit 0 o'clock 00 minute on the next day (step 407).

Figure 5:
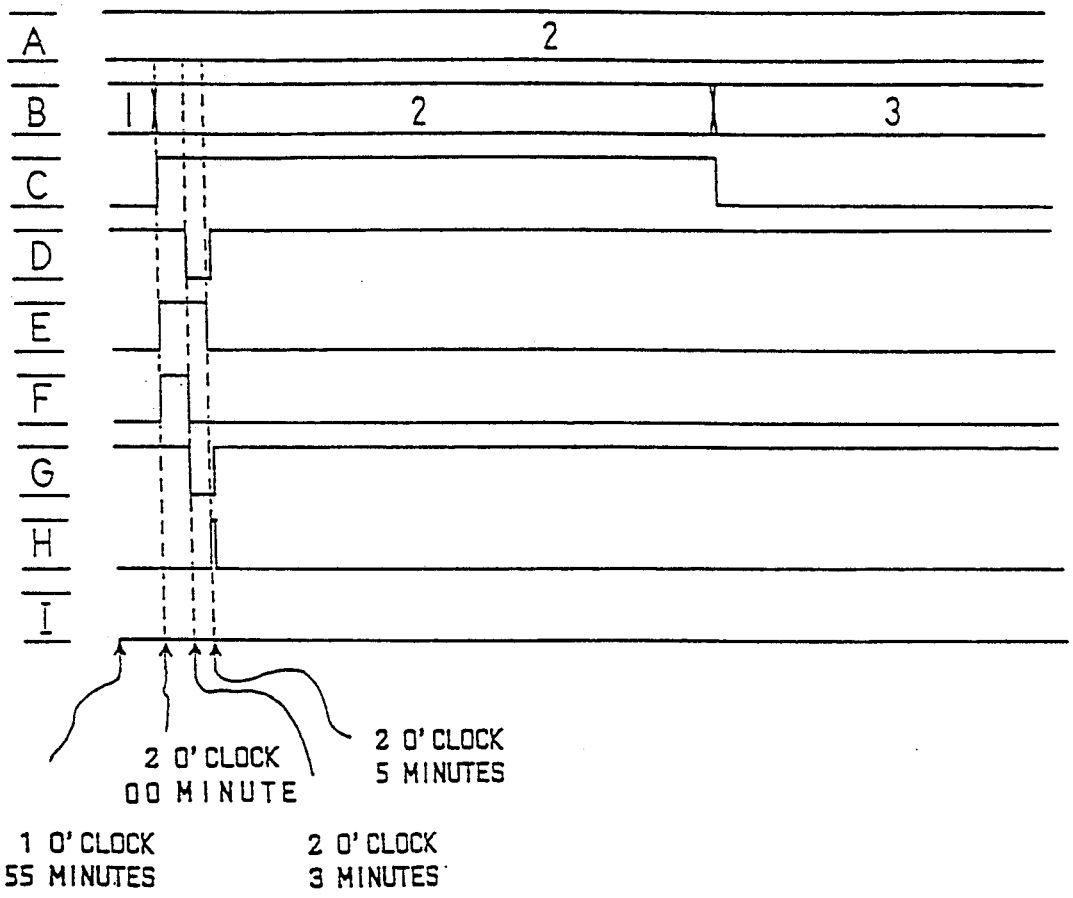
FIG. 5 is a detailed time chart of a radio wave-standardized electronic timepiece according to a first embodiment of the invention succeeds in automatic reception.
Figure 6:
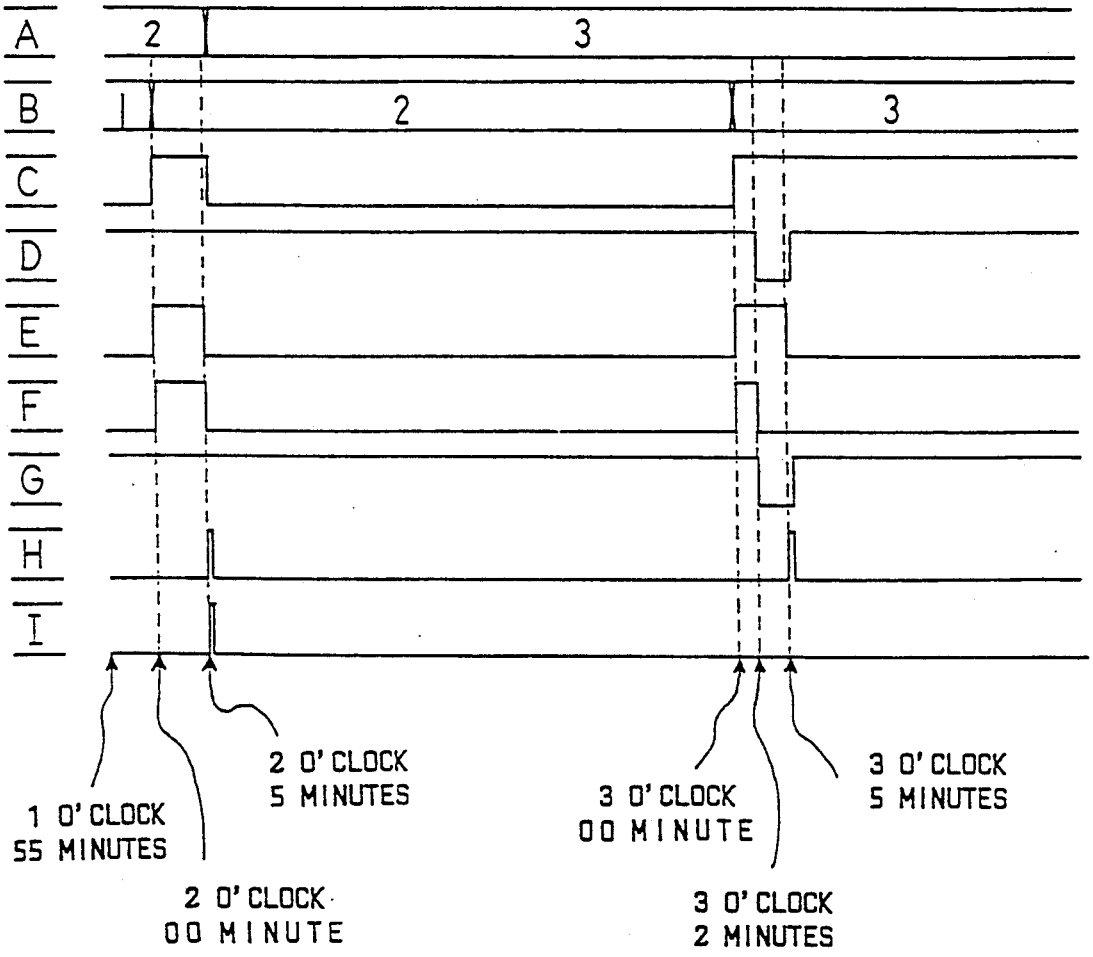
FIG. 6 is a detailed time chart illustrating the period of a radio wave-standardized electronic timepiece according to a first embodiment the invention succeeds in automatic reception after failing in automatic reception.
Figure 7:
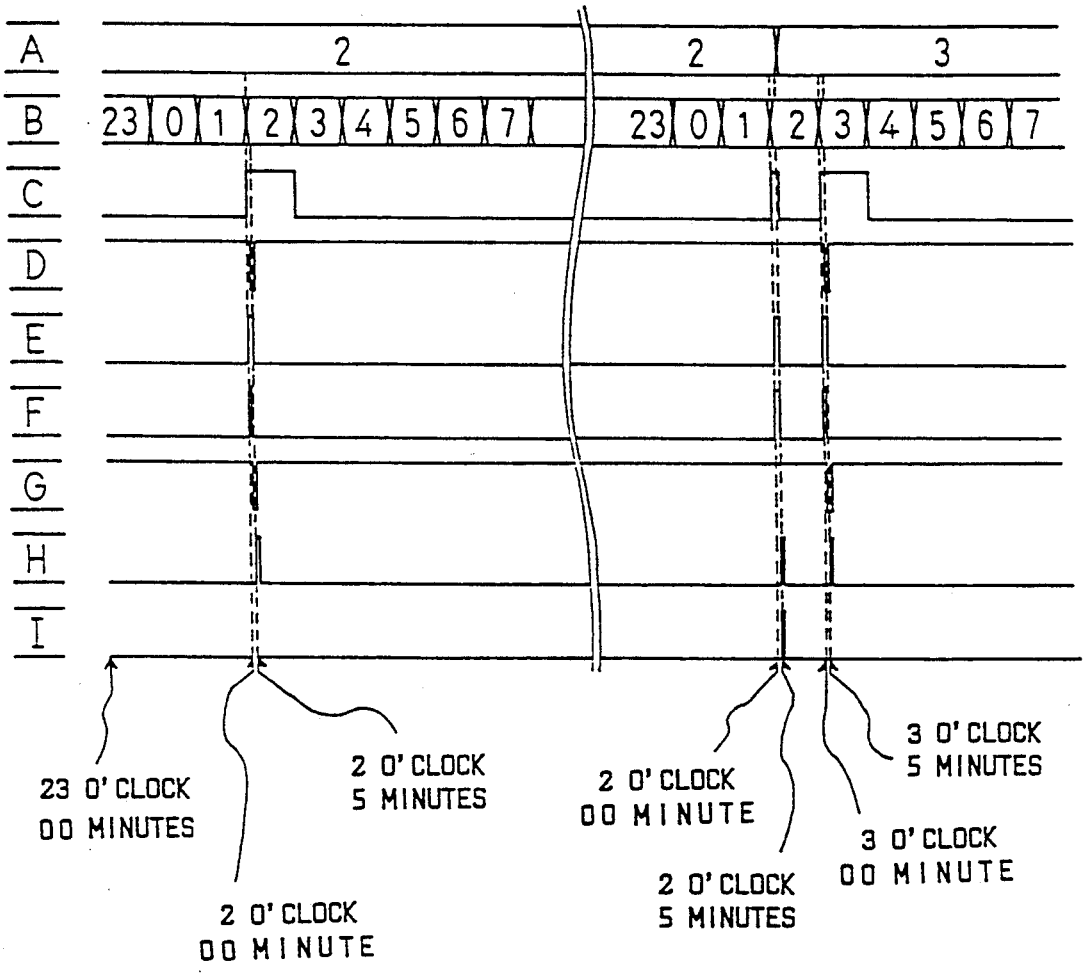
FIG. 7 is a diagrammatic time chart showing a continuation of FIGS. 5 and 6 of a radio wave-standardized electronic timepiece according to a first embodiment of the invention.

FIGS. 5, 6 and 7 are time charts for the reception time control means 18. A-I of FIGS. 5. 6 and 7 indicate output signals A-I shown in FIG. 3 and show the waveforms of the output signals at their respective locations against the time axis.

A indicates the waveform of the output from the 0–23 counter 23. B indicates the waveform of the output from the hour counter in the time counter 3. C indicates the waveform of the output from the comparator 24 and is the logical AND of A and B. D and G are waveforms obtained by inverting the outputs from the received data acceptance circuit 13 by an inverter.

E indicates the waveform of the output from the 5-minute timer 25. This waveform takes level 1 (high) for 5 minutes from the start. F indicates the waveform of the output from the two input AND circuit 26. This waveform is the logical AND of D and E. H indicates the waveform of the 5 minute end pulse delivered from the 5-minute timer 25. I indicates the waveform of the output from the two-input AND circuit 27. If this output assumes level 1 (high), 1 is added to the value of the 0–23 counter 23. I is the logical AND of G and H.

FIG. 5 is a detailed time chart illustrating automatic reception. This reception begins at 2 o'clock 00 minute. The received data acceptance decision circuit 13 determines that the received data contains given information when 3 minutes pass from the start of the automatic reception. Then, the reception is ended. Two o'clock 00 minute that is the instant at which reception was successfully made on the previous day is stored in the 0–23 counter 23. When the contents of the hour counter in the time counter 3 become 2 o'clock, C assumes level 1 (high). On the leading edge of C, the 5-minute timer 25 is started. E is retained at level 1 (high) for 5 minutes. D and G take level 1 (high) since the trailing edge of the 5-minute end pulse from the 5-minute timer 25 on the previous day. This level 1 is maintained until reception is successfully made when 3 minutes pass since the automatic reception has been performed.

If reception is made successfully, the received data acceptance decision circuit 13 produces level 1 (high). An inversion of this signal is supplied to D and G and so D and G are maintained at 0 (low) level up to the trailing edge of the 5-minute end pulse from the 5-minute timer 25. Since F is the logical AND of D and E, F is maintained at level 1 (high) while the 5-minute timer 25 is operating until reception is successfully made when 3 minutes pass since the automatic reception has been made.

When the period of the 5-minute timer 25 ends, a 5-minute end pulse is produced at H. Since reception is successfully made when 3 minutes elapse, it is not likely that G and H take level 1 (high) simultaneously. I is maintained at level 0 (low). Therefore, the 0–23 counter 23 is maintained at 2 o'clock 00 minute. On the next day, the automatic reception is started at 2 o'clock 00 minute.

FIG. 6 is a detailed time chart illustrating automatic reception starting at 2 o'clock 00 minute. Reception is not made successfully for 5 minutes since the automatic reception has been made. Automatic reception is restarted at 3 o'clock 00 minute. The received data acceptance decision circuit 13 determines that the received data contains given information when 2 minutes elapse since the automatic reception has been made. Then, the reception is ended.

The 0–23 counter 23 stores 2 o'clock 00 minute that is the instant at which reception was successfully made on the previous day. When the contents of the hour counter in the time counter 3 become 2 o'clock, C assumes state 1 (high). On the leading edge of C, the 5-minute timer 25 starts, and E is maintained in state 1 (high) for 5 minutes. D and G assume state 1 (high) on the trailing edge of the 5-minute end pulse from the 5-minute timer 25 on the pervious day. Since reception is not successfully made, the state is retained at 1 (high).

Since F is the logical AND of D and E, F is maintained in state 1 (high) while E is maintained in state 1 (high) for 5 minutes. When the period of the 5-minute timer 25 ends, a 5-minute end pulse is produced at H. Since reception is not made successfully within 5 minutes, I assumes state 1 (high) while the 5-minute timer 25 is delivering the 5-minute end pulse. Value 1 is added to the value of the 0–23 counter. In this way, A becomes 3 o'clock. Thus, C takes level 0 (low). At 3 o'clock 00 minute, the information delivered from the hour counter in the time counter 3 agrees with the information delivered from the 0–23 counter 23. Therefore, automatic reception is restarted. The timing from 3 o'clock illustrated in FIG. 6 is similar to the timing illustrated in FIG. 5 except that reception is successfully made when 2 minutes pass.

FIG. 7 is a continuation of FIGS. 5 and 6. The timing of the operation is the same as the timing illustrated in FIGS. 5 and 6. It can be seen from FIG. 7 that automatic reception for the next day is started since reception has been made successfully on the previous day.

Figure 8:
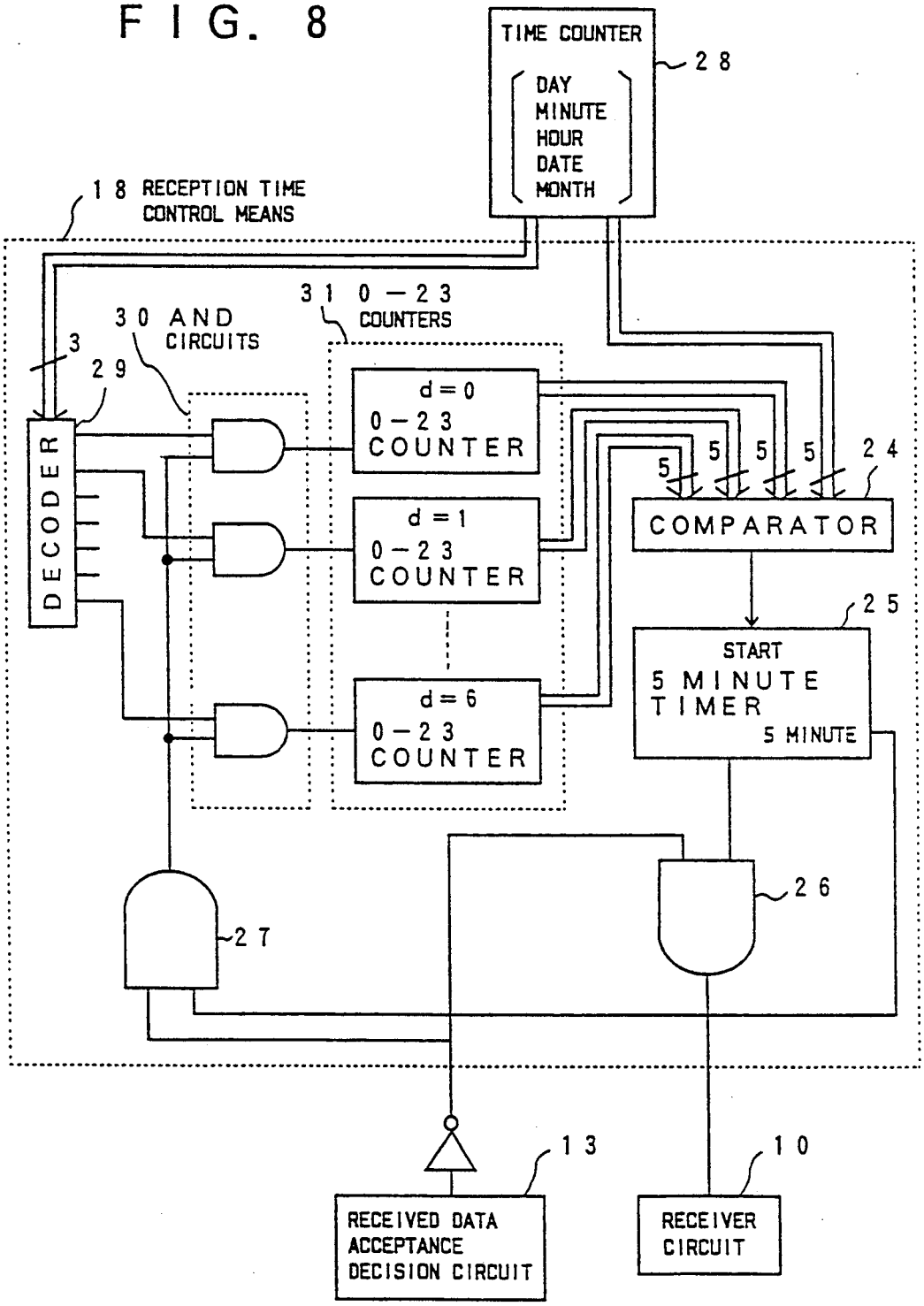
FIG. 8 is a detailed block diagram of the reception time control means of a radio wave-standardized electronic timepiece according to a second embodiment of the invention.
Figure 9:
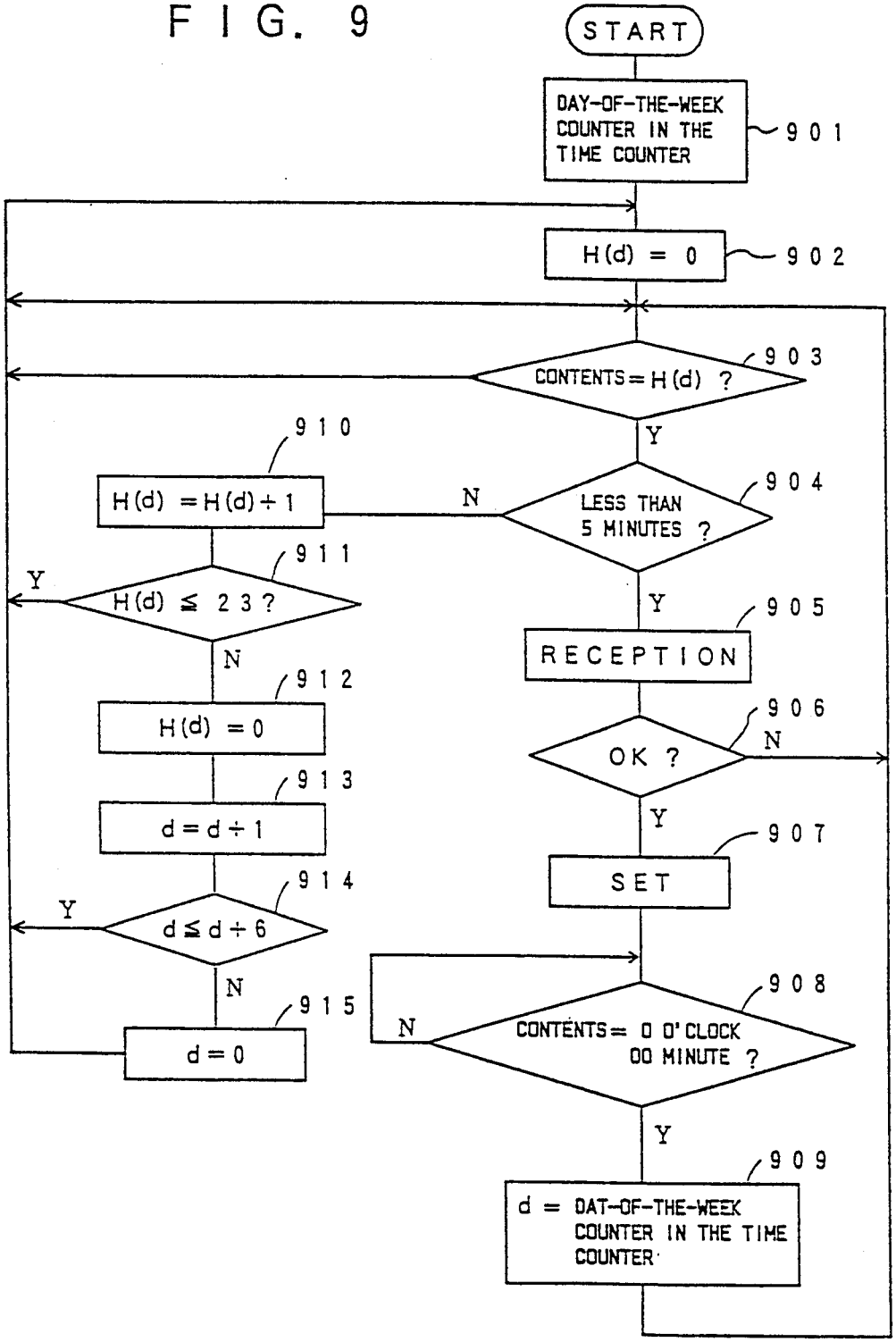
FIG. 9 is a diagrammatic flowchart illustrating the operation of the reception time control means of a radio wave-standardized electronic timepiece according to a second embodiment of the invention.

FIGS. 8 and 9 pertain to a radio wave-standardized electronic timepiece according to a second embodiment of the invention, the timepiece storing the instants at which reception was successfully made every day within one week. The timepiece starts reception at the stored time on each day of the week.

FIG. 8 is a detailed block diagram of the reception time control means 18. There are seven 0–23 counters 31 and store the instants at which reception was successfully made from Monday to Sunday, respectively. A decoder 29 receives the output signal from a day-of-the-week counter included in the time counter 28 and produces an output signal to each one input terminal of seven two-input AND circuits 30. The other input terminal of each of the AND circuits 30 receives the output signal from a two-input AND circuit 27. A comparator 24 compares the output signal from the hour counter in the time counter 28 with the output signals from the 0–23 counters. The operation from the comparator circuit 24 to the two-input AND circuit 27 is the same as the operation described in connection with FIG. 3.

FIG. 9 is a diagrammatic flowchart illustrating the operation of the reception time control means 18. Let d be the contents of the day-of-the-week counter in the time counter 28 (step 901). Let the initial values H(d) of 0–23 counters conforming to the contents d be 0 (step 902). The contents of the hour counter in the time counter 28 are compared with the contents H(d) of the 0–23 counters conforming to d (step 903).

A decision is made to see if a period of 5 minutes has not yet passed since the 5-minute timer 25 has been operated (step 904). If the elapsed time is longer than 5 minutes, the result of the decision is that the received data does not contain the given information within the period of 5 minutes. The reception is ended. Value 1 is added to the values H(d) of the 0–23 counters conforming to d (step 910). A decision is made to see if the values H(d) are less than 23 (step 911). If the result of the decision is greater than 23, the values H(d) of the 0–23 counters conforming to the contents d are set to 0 (step 912), and value 1 is added to d (step 913). A decision is made to see if d is not greater than 6 (step 914). If the result of the decision is that d is greater than 6, d is set to 0 (step 915).

If the result of the decision made in step 904 is that the period of 5 minutes has not yet passed, reception is made (step 905). A decision is made to see if the received data contains given information (step 906). If the received data contains the given information, the time counter 28 is modified according to the received data (step 907). The control is continued up to 0 o'clock 00 minute on the next day (step 908). When 0 o'clock 00 minute arrives on the next day, d is made equal to the contents of the day-of-the-week counter in the time counter (step 909).

Figure 10:
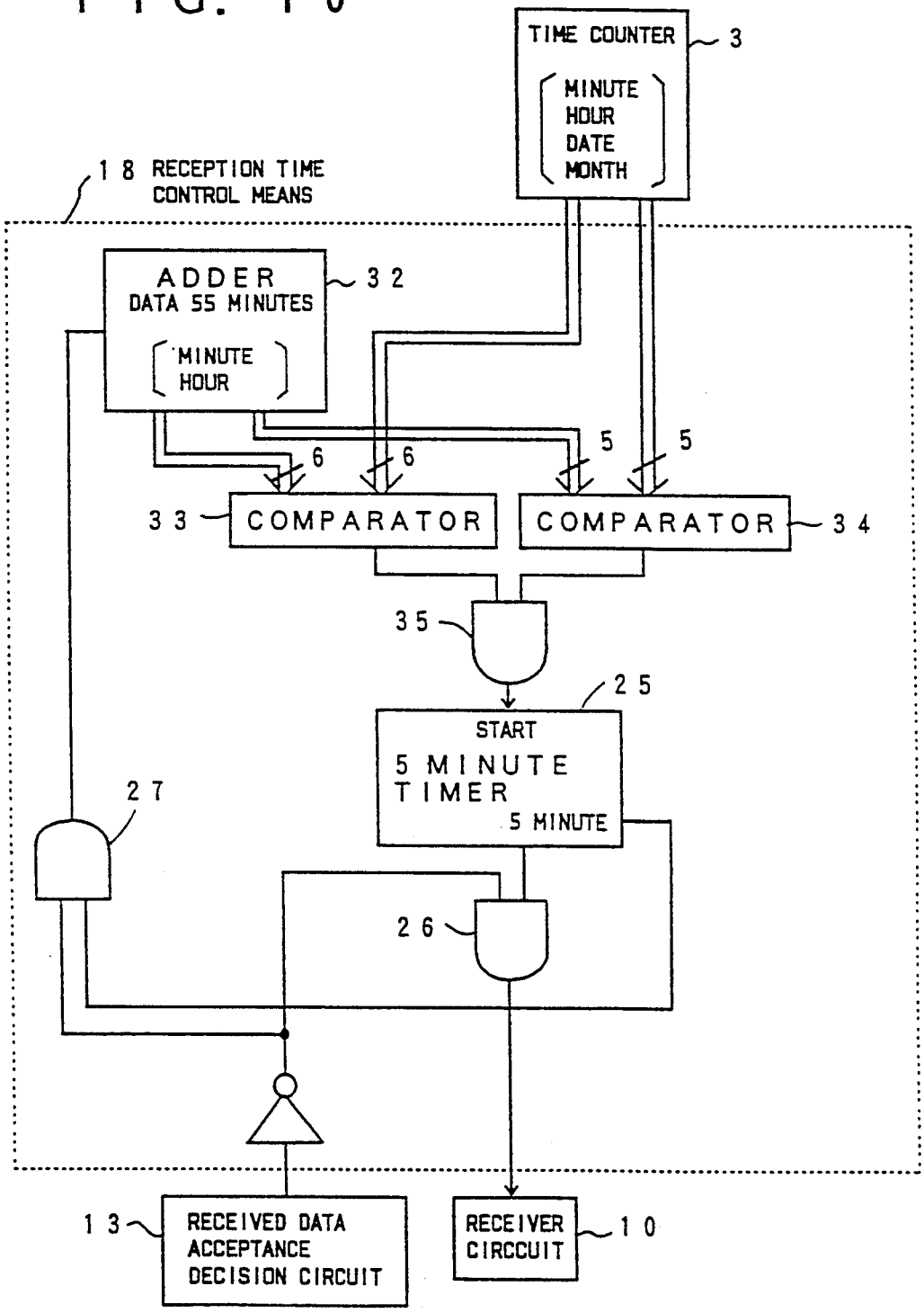
FIG. 10 is a detailed block diagram of the reception time control means of a radio wave-standardized electronic timepiece according to a third embodiment of the invention.
Figure 11:
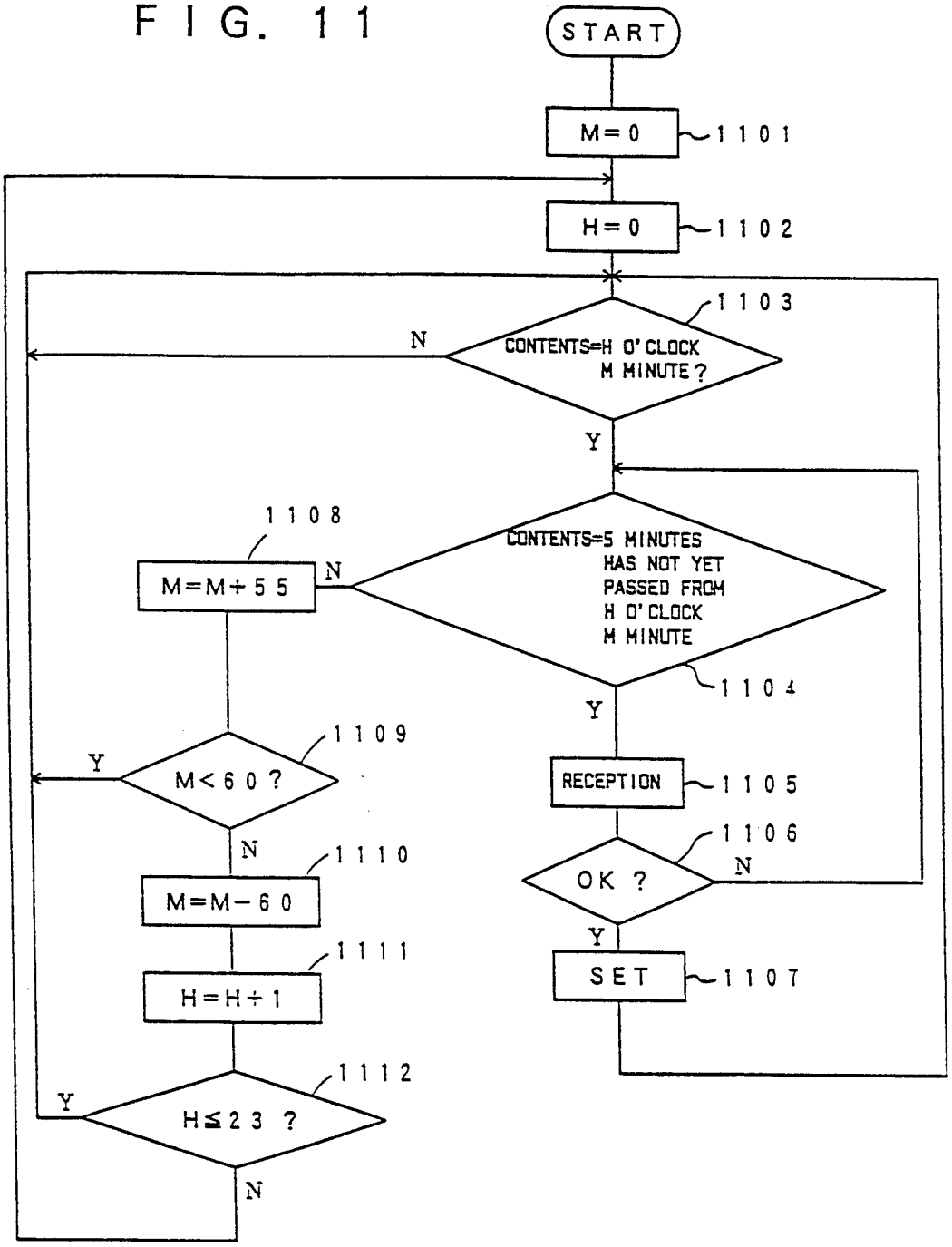
FIG. 11 is a diagrammatic flowchart illustrating the operation of the reception time control means of a radio wave-standardized electronic timepiece according to a third embodiment of the invention.

FIGS. 10 and 11 pertain to a radio wave-standardized electronic timepiece according to a third embodiment of the invention, the timepiece being so designed that if automatic reception is unsuccessful at any instant of time, the next automatic reception is started after a lapse of 55 minutes.

FIG. 10 is a detailed block diagram of a reception time control means 18.

An adder 32 sets the initial values of a minute counter and of a hour counter included in the adder 32 to 0. Subsequently, the adder 32 adds a period of 55 minutes that is a data value in response to the output signal from a two input AND circuit 27. A comparator 33 compares the output signal from a minute counter included in a time counter 3 with the output signal from a minute counter included in the adder 32. A comparator 34 compares the output signal from the hour counter included in the time counter 3 with the output signal from the hour counter included in the adder 32. If they agree, signal 1 (high) is produced in each case.

A two-input AND circuit 35 receives the output signals from the comparators 33 and 34. If the output assumes state 1 (high), the two-input AND circuit 35 starts a 5-minute timer 25. The operation from the 5-minute timer 25 to the two-input AND circuit 27 is the same as the operation described in conjunction with FIG. 3.

FIG. 11 is a diagrammatic flowchart illustrating the operation of the reception time control means 18. The initial value M of the minute counter inside the adder 32 is set to 0 (step 1101). Also, the initial value H of the hour counter inside the adder 32 is set to 0 (step 1102). The value M of the minute counter inside the adder 32 is compared with the value of the minute counter inside the time counter 3. The contents of the value H of the hour counter inside the adder 32 are compared with the contents of the hour counter inside the time counter 3 (step 1103). If they agree, the 5-minute timer 25 is started. A decision is made to see if a period of 5 minutes has not yet passed since the timer has been operated (step 1104).

If the elapsed time is longer than 5 minutes, the result of the decision is that the received data do not have the given information within 5 minutes. The reception is ended. A value of 55 is added to the value M of the minute counter inside the adder 32 (step 1108). A decision is made to see if the sum value is less than 60 (step 1109). If the sum value is not less than 60, 60 is subtracted from this value (step 1110). Then, 1 is added to the value H of the hour counter inside the adder 32 (step 1111). Thereafter, the hour counter inside the adder 32 is controlled (step 1112). If the result of the decision made in step 1104 is that the period is less than 5 minutes, reception is made (step 1105). A decision is made to see if the received data contains given information (step 1106). If the received data has the given information, then the time counter 3 is modified according to the received data (step 1107).

The electronic timepiece according to the present invention yields the following advantages.

(1) Since the time zone in which automatic reception is made is not fixed, the automatic reception can be made according to the living pattern of the user. That is, the time can be corrected. A timepiece which displays accurate time can be obtained.

(2) Since many users are considered to have periodic living patterns, the possibility of success of reception is made higher by the novel mechanism (i.e., the time at which reception is made successfully is stored, and subsequently the timepiece assumes automatic reception condition from the stored time) than that obtained by the prior art techniques. Also, the electric power consumed can be reduced.

What is claimed is:

1. A radio wave-standardized electronic timepiece comprising:

a time information calculation circuit for calculating and processing information about time or other information;

a display means which receives the output signal from the time information calculation means and displays the information;

a receiver means which receives a standard time signal produced externally and stores data about it;

a received data acceptance decision circuit which receives the output signal from the receiver means and makes a decision to see if the received data contains given information;

a transfer circuit that produces modifying pulses to the time information calculation circuit in response to the received data stored in the receiver means according to the output signal from the received data acceptance decision circuit;

a reception success time storage circuit that stores the time at which reception is made, in response to the output signal from the transfer circuit according to the output signal from the reception data acceptance decision circuit;

a reception time addition circuit that adds a given time according to the output signal from the received data acceptance decision circuit;

a reception success comparison circuit which receives the output signal from the reception success time storage circuit and the output signal from the time information calculation circuit and compares them;

a reception time comparison circuit which receives the output signal from the reception time addition circuit and the output signal from the time information calculation circuit and compares them; and a reception operation decision circuit which receives the output signal from the reception success comparison circuit and the output signal from the reception time comparison circuit and controls the operation of the reception means.

2. A radio wave-standardized electronic timepiece as claimed in claim 1;

wherein said reception success time storage circuit stores the times at which reception is made from Monday to Sunday, respectively.

3. A radio wave-standardized electronic timepiece as claimed in claim 1; further comprising reception starting means which count a given time when reception is unsuccessful, and output signal of next reception after the lapse of the given time.

* * * * *